United States Patent [19]

Webb et al.

[11] 4,295,075

[45] Oct. 13, 1981

[54] ARC DISCHARGE LAMP HAVING CERAMIC ARC TUBE

[75] Inventors: Edward A. Webb, Reading; John F. McKenna, Newburyport, both of Mass.; Frank B. Makar, Jr., Plaistow, N.H.

[73] Assignee: GTE Products Corporation, Stamford, Conn.

[21] Appl. No.: 103,659

[22] Filed: Dec. 14, 1979

[51] Int. Cl.[3] ..... H01J 17/16

[52] U.S. Cl. ..... 313/220; 313/217; 313/318; 313/331; 313/335; 29/25.1; 29/25.13

[58] Field of Search ..... 313/220, 318, 217, 331, 313/335; 29/25.1, 25.11, 25.13; 174/138 H

[56] References Cited

U.S. PATENT DOCUMENTS

| | | | |
|---|---|---|---|
| 3,243,635 | 3/1966 | Louden et al. | 313/220 X |
| 3,317,777 | 5/1967 | Algar et al. | 313/220 UX |
| 3,476,969 | 11/1969 | Ennulat et al. | 313/220 X |
| 3,564,328 | 2/1971 | Bagley et al. | 313/220 |
| 3,716,743 | 2/1973 | Mizuno et al. | 313/220 |
| 3,821,587 | 6/1974 | Liberman et al. | 313/217 |
| 3,855,495 | 12/1974 | Pappas et al. | 313/220 X |
| 3,898,494 | 8/1975 | Levy | 313/217 X |
| 3,995,183 | 11/1976 | Lechner et al. | 313/217 X |
| 4,037,129 | 7/1977 | Zack et al. | 313/229 X |
| 4,221,987 | 9/1980 | Kerekes | 313/227 X |

*Primary Examiner*—Stanley T. Krawczewicz
*Attorney, Agent, or Firm*—James Theodosopoulos

[57] ABSTRACT

An arc discharge lamp comprises a ceramic arc tube having an electrode at each end, each electrode being mounted on a support member. A ceramic adapter is sealed to a ceramic cylinder which is sealed to the end of the arc tube. The support member extends through the cylinder into the adapter where it is connected to an externally extending lead-in wire by means of a spiral refractory-metal connector. The connector is flexible enough to withstand the thermal stresses resulting from the normal high operating temperature of the lamp.

5 Claims, 1 Drawing Figure

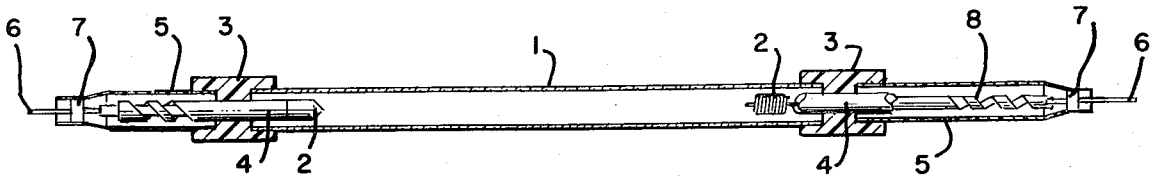
6
7
8
5
3
4
2
1
2
4
3
5
7
6

ARC DISCHARGE LAMP HAVING CERAMIC ARC TUBE

DESCRIPTION

1. TECHNICAL FIELD

This invention is concerned with arc discharge lamps employing ceramic arc tubes and which can be operated in air.

2. BACKGROUND ART

An example of an arc discharge lamp having a ceramic arc tube is the high pressure sodium lamp shown in U.S. Pat. No. 4,037,129. Such arc tubes are generally enclosed within an outer jacket containing a nonoxidizing atmosphere in order to prevent oxidation of the metal lead-in conductors extending out of the arc tube, the operating temperature thereof being sufficiently high to result in oxidation if air is present. In some cases it is desirable to operate such ceramic arc tubes without an outer jacket, as shown, for example in U.S. Pat. Nos. 3,821,587 and 3,898,494.

This invention is concerned with an arc discharge lamp having a ceramic arc tube that can be operated without an outer jacket, but having an improved construction.

DISCLOSURE OF INVENTION

An arc discharge lamp in accordance with this invention comprises a ceramic arc tube, the ends of which are sealed to larger diameter ceramic cylinders which, in turn, are sealed to ceramic adapters. Disposed within the ceramic arc tube at each end thereof is the usual electrode. Extending externally from the end of each adapter is a lead-in wire. The electrical connection between each electrode and lead-in wire is flexible in order to withstand thermal cycling.

BRIEF DESCRIPTION OF THE DRAWING

The single FIGURE in the drawing is a longitudinal cross-sectional view of a ceramic discharge lamp in accordance with this invention.

DESCRIPTION OF A PREFERRED EMBODIMENT

An arc discharge lamp in accordance with this invention comprises a ceramic, for example, sapphire or polycrystalline alumina, arc tube 1 containing an electrode 2 at each end. A ceramic, for example, polycrystalline alumina, cylinder 3 is sealed at each end of arc tube 1 with the usual high temperature sealing glass. Cylinder 3 has a double inside diameter, the larger diameter being a slip fit for arc tube 1 and the smaller diameter being a slip fit for tubular metal member 4, member 4 being the support for electrode 2. Support member 4 is sealed to ceramic cylinder 3 with the usual high temperature sealing glass and is welded to the electrode 2. One end of a ceramic, for example, polycrystalline alumina, tubular adapter 5 is sealed to each ceramic cylinder 3 with the usual sealing glass. Adapter 5 has about the same diameter as arc tube 1 and is a slip fit into the larger inside diameter of cylinder 3 where the seal is made. At the other end of each adapter 5 there is an external lead-in wire 6. Lead-in wire 6 extends into adapter 5 through a slight clearance hole in a ceramic disc 7 which is interference-fusion sealed inside adapter 5, say, about $2\frac{1}{2}$ mm from the end. Lead-in wire 6 is made, for example, of kovar wire and is sealed to disc 7 in a manner to be subsequently described.

Electrical connection between support member 4 and lead-in wire 6 is made by means of a spiral conductor 8 welded, for example, to each. Conductor 8 is spaced from the walls of adapter 5 and there is sufficiently flexibility in conductor 8 to withstand the thermal stresses of normal on-off lamp operation. Support member 4 and spiral conductor 8 are made of a suitable refractory metal, for example, niobium. Spiral conductor 8 is domed over by welding and is welded to support member 4.

Arc tube 1 contains a discharge-sustaining fill including, for example, sodium and also contains a starting gas, for example, argon at a pressure, typically, of 100 torr. Ceramic adapter 5 contains a nonoxidizing atmosphere which can be the same gas used in arc tube 1.

The seal of lead-in wire 6 to ceramic disc 7 can be made as follows. A bead of sealing glass, for example, of No.7052, having a lower sealing temperature than the previously mentioned usual high temperature sealing glasses is disposed around lead-in wire 6 resting on ceramic disc 7 with the arc tube in a vertical position, the present seal to be made being uppermost and being the final seal for the lamp. The arc tube is placed in a bell jar containing an argon atmosphere. There is sufficient clearance around lead-in wire 6 in the hole of disc 7 so that there is ready passage of the argon into adapter 5. The argon pressure in the bell jar is established at 450 torr and heat is applied around the sealing glass bead until it reaches its softening temperature, say, about 700° C. The argon pressure in the bell jar is then raised to 600 torr and additional heat is applied to the bead to raise it to its sealing temperature of 1100° C., at which time the sealing glass is pressed against disc 7 to form a hermetic seal. The reason for increasing the bell jar argon pressure to 600 torr after the sealing glass has softened is to prevent blowout of the sealing glass, since the argon pressure in adapter 1 will increase above 450 torr as a result of the heat applied to melt the sealing glass.

We claim:

1. An arc discharge lamp comprising: a ceramic arc tube having an electrode at each end, each electrode being mounted on a support member; a ceramic cylinder at each end of the arc tube, the arc tube fitting inside one end of the ceramic cylinder and being sealed thereto; a ceramic adapter fitting into the other end of the ceramic cylinder and being sealed thereto; a lead-in wire extending into, and externally of, the ceramic adapter and being sealed thereto; the support member extending through the ceramic cylinder into the ceramic adapter and being sealed to the ceramic cylinder; and a spiral refractory-metal conductor disposed within the ceramic adapter and electrically connecting the support member to the lead-in wire.

2. The lamp of claim 1 wherein the ceramic adapter contains a nonoxidizing gas.

3. The lamp of claim 1 wherein the spiral refractory-metal conductor is axially disposed in the ceramic adapter.

4. The lamp of claim 1 wherein the glass used for sealing the lead-in wire to the ceramic adapter has a lower sealing temperature than the glass used for sealing the ceramic adapter to the ceramic cylinder.

5. The method of making an arc discharge lamp comprising the steps of: preparing an arc tube assembly including an arc tube, a ceramic cylinder sealed to the arc tube, a ceramic adapter sealed to the ceramic cylinder, and an electrode within the arc tube mounted on a support member extending into the adapter where it is connected to a lead-in wire extending externally of the adapter through a small clearance hole in a disc which is sealed to the adapter a short distance from the end thereof; disposing a glass bead around the lead-in wire at the end of the adapter; placing the arc tube assembly into a chamber and filling the chamber with a nonoxidizing gas to a predetermined pressure; heating the glas bead to its softening temperature; raising the pressure within the chamber; and heating the glass bead to its sealing temperature to effect a heremetic seal between the lead-in wire and the disc.

* * * * *